US006344311B1

(12) United States Patent
De Keyzer et al.

(10) Patent No.: US 6,344,311 B1
(45) Date of Patent: Feb. 5, 2002

(54) PHOTOSENSITIVE SILVER HALIDE ELEMENT WITH INCREASED PHOTOSENSITIVITY

(75) Inventors: René De Keyzer, Waasmunster (BE); Mona Treguer, Paris (FR); Jacqueline Belloni, Lozere (FR); Remita Hynd, GIF/Yvette (FR)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/667,219

(22) Filed: Sep. 21, 2000

Related U.S. Application Data

(62) Division of application No. 09/209,761, filed on Dec. 11, 1998

(60) Provisional application No. 60/073,789, filed on Feb. 5, 1998.

(30) Foreign Application Priority Data

Dec. 11, 1997 (EP) ..... 97203897

(51) Int. Cl.[7] ..... G03C 1/015

(52) U.S. Cl. ..... 430/569

(58) Field of Search ..... 430/569

(56) References Cited

U.S. PATENT DOCUMENTS 5,763,151 A * 6/1998 Brust et al. ..... 430/569
5,965,343 A * 10/1999 Nishimura ..... 430/567

* cited by examiner

*Primary Examiner*—Hoa Van Le
(74) *Attorney, Agent, or Firm*—Breiner & Breiner, L.L.C.

(57) ABSTRACT

A photosensitive element comprising a silver halide emulsion having silver halide grains containing an organic hole-trapping dopant. In a preferred embodiment said dopant is represented by formula (I):

R—COOM (I)

wherein

R is hydrogen, a substituted or unsubstituted alkyl group, a substituted or unsubstituted aryl group, a substituted or unsubstituted aralkyl group or hetero-aryl group, and M is hydrogen or any metal or organic group which can form a salt or by formula (II):

(II)

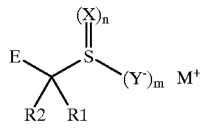

wherein:

X and Y are independently selected from 0, S, Se, m is 1 and n is 1 or 2,

R1 and R2 are hydrogen, a substituted or unsubstituted alkyl group, a substituted or unsubstituted aryl or aralkyl group or a substituted or unsubstituted heteroaryl group, wherein R1 and R2 may be the same or different and may form a ring, E represents a group linked to the carbon atom by a heteroatom, having at least one free electron pair, M+ is a proton or an organic or inorganic (metal) counterion.

Moreover the invention provides a photosensitive element where said photosensitive element can be a photoadressable thermographic element. The invention also provides a method for preparing said photosensitive element comprising a support and on one or both sides thereof at least one silver halide emulsion layer wherein the silver halide grains are doped with an organic hole-trapping dopant according to formula (I) or (II), optionally carried out in the presence of a oxidizing agent.

9 Claims, No Drawings

PHOTOSENSITIVE SILVER HALIDE ELEMENT WITH INCREASED PHOTOSENSITIVITY

This is a division of application Ser. No. 09/209,761 filed Dec. 11, 1998 which claims benefit of No. 60/073,789 filed Feb. 5, 1998.

FIELD OF THE INVENTION

The present invention relates to a photosensitive element comprising on a support a silver halide emulsion demonstrating an improved photosensitivity by using a new type of doping agents and a method for preparing said photosensitive element.

BACKGROUND OF THE INVENTION

The photographic industry is working with photographic materials which have to respond to light with a well-defined minimum energy content. This light energy should trigger a chemical or physical activity leading to a change in the illuminated material which is immediately visible or only intrinsically present and can be visualized afterwards by an additional treatment also called processing step. However already for a long time there exists a strong and an even increasing demand for photosensitive materials that have improved sensitivity, that is for materials that respond to a decreasing amount of light energy. One of the most interesting possibilities is found in photosensitive materials wherein the primary light-activated change exists on an atomic or molecular base which in a secondary step can be multiplicated by several orders of magnitude in order to visualize the first light interaction in the material. This 'two-step' image formation mechanism is for instance encountered in silver halide materials which form the main subject of the present invention. It will be clear that sensitivity in this type of materials is determined by the efficiency in which the different steps between the light interaction with the silver halide and the formation of the visual image can proceed. This invention will be specially focused on the way in which the first molecular light-induced change in silver halide crystals (also called latent image) is realized. This change after development gives rise to the formation of a visual image.

The efficiency of the latent image formation depends on many factors and can therefore be influenced in many different ways. The best result is realized if each photoelectron in the silver halide crystal reaches the deepest electron trap while forming the latent image. This means that the recombination between holes and electrons that are created after light absorption is prevented as much as possible. Many solutions are proposed but all of them have a limited result. One can primarily try to lower the depth of electron trap in order to increase the capture probability. Chemical sensitization with for instance sulphur, gold, selenium and other compounds or combinations thereof is mostly used for this purpose.

Another way in preventing the recombination of holes and electrons after formation is the temporary interception of these species at local traps with intermediate trap depth. This can be done by creating a distortion internally in the crystal latice for instance by the local incorporation of an increased amount of iodide in the core or in a small zone of the grain. Although this method leads to a sensitivity gain by decreasing the electron-hole recombination, another important feature like developability, which is desired in modern photographic materials is deteriorated by the presence of the iodide.

Increasing the sensitivity of a silver halide emulsion can also be realized by increasing the efficiency of electron transfer from the spectral sensitizer to the silver halide grain which principally can be carried out with a supersensitizer.

Looking at the activity of the sensitizing dye, sensitivity gain can also be realized by decreasing the dye desensitization which is evolved by increasing dye concentration at the grain surface. This can for instance be done by combining a electron donating compound like ascorbic acid with specific cyanine and merocyanine dyes as described in U.S. Pat. No. 4,897,343. Electron-donating compounds that are attached to a sensitizing dye or a silver halide absorptive group have also been used to get a additional sensitizing effect. Examples are described in U.S. Pat. Nos. 5,436,121, 5,478,719 and 4,607,006.

Another interesting alternative in order to decrease recombination is introducing hole traps like silver clusters or some metal ions or complexes in the silver halide crystal. One of the metal salts which can be used comprises iron as is described, for instance, in U.S. Pat. Nos. 5,166,044 and 5,420,001, where the iron ions are incorporated in silver halide emulsions rich in silver chloride (≧90 mole % of AgCl). The sensitivity increase is caused by a ferro or ferri salt, wherein the (inorganic or organic) anion can be freely choosen. The choice of the anion does not influence the desired effect as has extensively been demonstrated. Further hole-trapping entities which were already mentioned are silver clusters. These can be created in the crystals by reduction sensitization which is realized by treating the emulsion during the precipitation with a reductor like tin compounds, polyamine derivatives, hydrazines, ascorbic acid and analogues, etc. or by well defined pH- and/or pAg-conditions without using reducing substances. So in U.S. Pat. No. 3,892,574 a method has been described, wherein during precipitation of the silver halide or before or during physical ripening small silver specks (which do not give spontaneously developable fog) are created in reducing conditions. The same can be said for silver halide preparation methods as described in U.S. Pat. No. 3,957,490, where at the end of a reduction periode an oxidant is introduced in the silver halide emulsion before chemical sensitization. Most of the methods concerning silver cluster formation by reduction sensitization give (more or less) rise to fog which is known as a serious problem. Experimental evidence has been found that these silver clusters can easily be formed on {111}-AgBr crystal faces while it becomes difficult for instance on {100}-AgBr or on {100}-AgCl crystal faces. For this reason a more general method is needed which can form hole-trapping entities in all kind of silver halide crystals in order to improve the sensitometric characteristics.

OBJECTS OF THE INVENTION

It is therefore a first object of the present invention to provide a photosensitive element comprising a silver halide emulsion with improved sensitivity and covering power.

It is a further object of the present invention to provide a photosensitive silver halide emulsion comprising silver halide grains containing a new category of doping agents.

It is another object of the present invention to provide a method for preparing a photosensitive element comprising a silver halide emulsion treated with said new category of doping agents during precipitation.

Further objects and advantages of the invention will become apparent from the description with the accompanying examples as given hereinafter.

SUMMARY OF THE INVENTION

The above mentioned objects are realized by a photosensitive element comprising a silver halide emulsion having silver halide grains containing an organic hole-trapping dopant. More particularly said organic hole trapping dopant is represented by formula (I):

$$R—COOM \quad (I)$$

wherein

R represents hydrogen, a substituted or unsubstituted alkyl group, a substituted or unsubstituted aryl group, a substituted or unsubstituted aralkyl group or hetero-aryl group, and M is hydrogen or any metal or organic group which can form a salt or by formula (II):

(II)

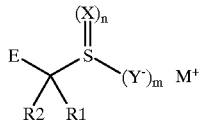

wherein:

X and Y are independently selected from O, S, Se, m is 1 and n is 1 or 2

R1 and R2 are hydrogen, a substituted or unsubstituted alkyl group, a substituted or unsubstituted aryl or aralkyl group or a substituted or unsubstituted heteroaryl group, wherein R1 and R2 may be the same or different and may form a ring;

E represents a group linked to the carbon atom by a heteroatom, having at least one free electron pair;

$M^+$ is a proton or an organic or inorganic counterion.

The invention further provides a photosensitive element where said photosensitive element can be a photoadressable thermographic element. The invention also provides a method for preparing said photosensitive element comprising a support and on one or both sides thereof at least one silver halide emulsion layer wherein the silver halide grains are doped with an organic hole-trapping dopant according to formula (I) or (II), optionally carried out in the presence of a oxidizing agent.

Preferred embodiments of the invention are disclosed in the dependent claims.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications and equivalents as may be included within the spirit and scope of the invention as defined by the appending claims.

The present invention as described in the foregoing summary will be explained in detail now. It has been found surprisingly that the sensitivity of photosensitive materials comprising a silver halide emulsion can be improved as referred to hereinbefore by the introduction of organic molecules that can be described as hole-trapping dopant. These products are organic compounds which can be incorporated in silver halide during the growth phase or step of the precipitation of the silver halide grains. These compounds are able to release under certain circumstances or conditions at least one, mostly two or generally a certain amount of two electrons (i.e. 2, 4, etc). Important is that in contrary with the hole-trapping agents which are generally known in the art the organic hole-trapping dopant of this invention does not get its trapping activity from a metal atom in its lowest valency state, if desired surrounded by its ligands. Unlike this it concerns an organic molecule that can deliver its electrons in the silver halide crystal after defragmentation of a part of the molecule.

An important compound which can be used as an organic hole-trapping agent for this purpose is characterized by the following formula (I):

$$R—COOM \quad (I)$$

or by formula (II):

(II)

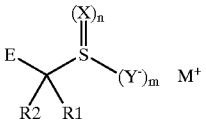

Organic molecules satisfying formula (I) and (II) indeed act as hole-trapping agents after incorporation in the silver halide lattice. A hole-trapping agent can, in most general terms, be defined as a compound which releases one or more electron(s) for reaction with a positive hole formed in the silver halide crystal lattice after absorption of an photon.

R in formula (I) is represented in a first embodiment by a hydrogen atom which means that formic acid or an inorganic or an organic salt thereof is used as hole-trapping dopant in the present invention. In a further embodiment R is an unsubstituted or a substituted alkyl group which may contain all kinds of functional groups as substituent like a hydroxyl-group, an amine-group, a carboxyl-group, a carboxylic acid group or other functional groups. Of special interest are the α-hydroxy-carboxylic acids or salts thereof and also α-amino-carboxylic acids or salts thereof where the nitrogen atom of the amino-group can be a part of a ring structure. It also means that the salts of polyacids like oxalic acid, malonic acid, maleinic acid, etc but also of tri-, tetra- and higher carboxylic acids are included in the formulae for organic hole-trapping dopants which are falling within the scope of the present invention.

In a further embodiment R represents an unsubstituted or a substituted aryl-group, an unsubstituted or a substituted aralkyl-group or an unsubstituted or substituted hetero-aryl group which may contain all kinds of functional groups as substituent like a hydroxyl-group, an amine-group, a carboxyl-group, a carboxylic acid group or other functional groups.

M in formula (I) as well as in formula (II) represents any of the metals of the Periodic System of Elements, wherein more particularly metals forming a water soluble salt with the carboxylic acid group represented in formula (I) or with the sulfinic acid group represented in formula (II) are preferred. M preferably is an alkaline or alkaline earth metal or a an organic group which can be an unsubstituted or substituted ammonium-cation in form of $N^+R^3R^4R^5R^6$, wherein the groups $R^3$ to $R^6$ may be the same or different and wherein each of $R^3$ to $R^6$ independently present hydrogen, unsubstituted or substituted alkyl, unsubstituted or substituted aryl or a phosphonium, selenonium, iodonium, telluronium or sulphonium ion. In this group the alkaline earth metals and, even more preferred the alkaline metals, are most preferred in the context of the present invention.

It is clear that the size of the molecule represented by formula (I) is an important factor with respect to incorporation in the silver halide matrix which means that e.g. HCOOM is more effective than $CH_3COOM$. The valency of the metal atom can be one, two or even more, one however being preferred. Like the anion which is a part of the compound represented by formulae (I) and (II) the organic cation should preferably be as compact as possible too, although this is no definite restriction for its incorporation.

Typical examples of hole trapping agents according to the formula (II) are given hereinafter (see compounds II.1 to II.9)

compound II.1

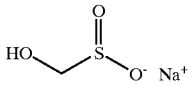

compound II.2

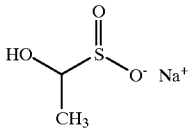

compound II.3

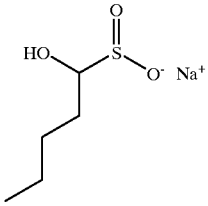

compound II.4

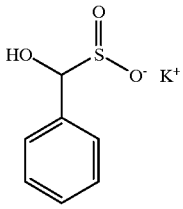

compound II.5

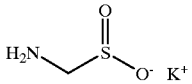

compound II.6

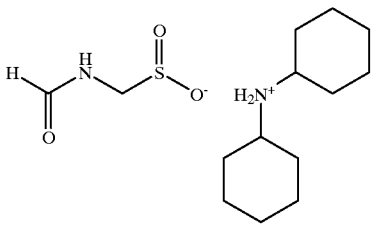

-continued compound II.7

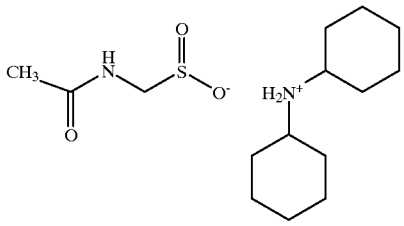

compound II.8

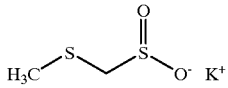

compound II.9

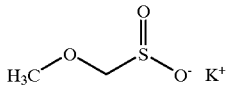

compound II.10

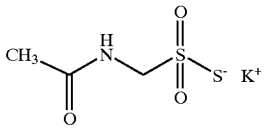

compound II.11

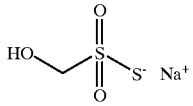

α-hydroxymethyl sulfinic acids or salts thereof are commercially available (as "rongalite") or can be prepared as described by Mulliez and Naudy (Tetrahedron 49 (1993), p.2469–2476). In this publication, references are found to older publications, describing the preparation of α-hydroxylmethyl sulfinic acids. The synthesis of α-aminomethyl sulfinic acids has been described by Mulliez et al. When R1 and R2 represent hydrogen they readily available from rongalite (J. Org Chem. 61 (1996), p. 5648–5649). Further preparation methods have been described in WO 9804522 A1 and Tetrahedron, 50 (18), p. 5401–5412.

In a preferred embodiment of the present invention the photosensitive element comprises silver halide emulsion crystals including as organic hole-trapping dopant a rongalite according to the formula (II), present therein as a sulfinic acid or as an inorganic or organic salt thereof.

The formation of a silver halide emulsion can be carried out by introducing a soluble silver salt together with a soluble halide salt as reactants in an aqueous solution of a binder like gelatine. After a first nucleation step where the nuclei are formed, growth will proceed under continuous addition of both reactants. During precipitation the whole process can be carried out in conditions of pAg- and/or pH-control.

Compounds of the present invention which satisfy formula (I) or (II), and even combinations of both of them, can be introduced during precipitation of the silver halide grains in different ways: via the silver salt inlet, the halide salt inlet or via a separated third inlet system. Attention has to be paid to the position of the third inlet which is used for the addition of the hole-trapping agent of the present invention. This has to be mounted in such a way that the hole-trapping agent is supplied underneath the surface of the solution where the silver halide is precipitated. Further this inlet itself has to be positioned closer to the silver salt inlet than to the halide inlet. The injection of the hole-trapping agent as close as possible to the silver salt inlet is preferred while the combined and simultaneous addition of the hole-trapping agent and the silver salt solutions through one inlet is one of the ultimate and most preferred configurations which can be used in the present invention. This can be said from all the systems in which solutions of hole-trapping agent and silver salt are mixed together before the formation of the silver halide itself.

Introduction can be carried out during the whole precipitation step of the silver halide emulsion grains or crystals which means starting from the beginning until the end of the growth step. The introduction can further be done with a constant flow rate but also with a increasing, decreasing or fluctuating flow rate or even with a flow which is intermitted once or several times. This means that all types of concentration profiles of the compounds satisfying formula(e) (I) and/or (II) in the silver halide grains are possible.

The addition can be carried out under hydrostatic pressure as driving force or by an motor-driven injection system which, if desired, can be performed automatically and computor controlled. So the organic hole-trapping dopant can be situated anywhere in the crystal, which means in the whole crystal or located in the core or in one or more shells surrounding said core. The amount of organic hole-trapping dopant preferably used in the present invention is situated between $10^{-8}$ and $10^{-2}$ mole per mole of silver halide, more preferably between $5.10^{-8}$ and $5.10^{-3}$, but most preferably between $10^{-7}$ and $5.10^{-3}$ mole per mole of silver halide.

An important element in the context of the present invention is the presence of an oxidizing agent during the addition of the compounds according to the formula(e) (I) and/or (II) at the precipitation stage. This oxidizing agent is preferably present before the organic hole-trapping dopant is injected in the precipitation step of the silver halide emulsion crystals. The addition can be carried out at once or in a well-defined period of time, preferably under stirring conditions in both cases. The addition of the oxidizing agent may start before and run together with the addition of the hole-trapping dopant. The type of oxidizing agent which should be used depends on the oxidizing power required to get optimal hole-trapping results but the actual experimental result can also be influenced by the amount of the chosen oxidizing agent. The most preferred oxidizing agent in connection with the present invention is p-toluene thiosulphonic acid or its salt which can be a sodium salt or, if desired, any other metal salt. This way of working is specific for the present invention and differs from other methods used untill now as the one e.g. described in U.S. Pat. No. 3,672,901 wherein an oxidizing agent is introduced at the start of the precipitation which creates a grain wherein internal reduction is partly or completely excluded. This situation is the same for the procedure wherein the addition of the oxidizing agent is carried out at the end of the precipitation in the presence of a reducing agent as described in U.S. Pat. No. 3,957,490.

A lot of parameters like sensitivity, gradation, pressure sensitivity, high or low intensity reciprocity failure, stability, dye desensitization, and several other sensitometric aspects of a photosensitive silver halide emulsion can also be modified by selection of a dopant as known in the art but in a different way as with the organic hole-trapping dopants of the present invention. The activity of dopants are influenced by the type of dopant, its concentration and its location in the silver halide crystal.

The silver halide emulsion as mentioned hereinbefore can be prepared in various ways by conventional methods. As already shortly summarized these methods always start with a nucleation step followed by a grain growth step. In the emulsion preparation reactants are added to the reaction vessel in form of solutions of silver and halide salts or in the form of preformed silver halide nuclei or fine grains which easily dissolve in the precipitation medium. The individual silver and halide salt solutions can be added through surface or subsurface delivery tubes by hydrostatic pressure or by an automatic delivery system for maintaining the control of pAg and/or pH in the reaction vessel and of the rate of the reactant solutions introduced therein. Adjustment of the pAg and pH value is further very important with respect to the use of compounds which satisfy formulae (I) and (II) of the present invention while said adjustment clearly determines the activity of these hole-trapping dopants. The pH value is therefore preferably situated between 1 and 10 but most preferably between 2 and 8. Otherwise the pAg value is preferably situated between 2 and 9 and most preferably between 3 and 8.

As taught for the compounds used in the present invention the reactant solutions or dispersions for the preparation of the silver halide itself can be added at a constant rate or at a constantly increasing, decreasing or fluctuating rate, if desired in combination with stepwise delivery procedures. More details about all possible ways in making a silver halide emulsion which can principally be used in this invention are summarized in Research Disclosure, item No. 38957, published September 1996, section I-C.

According to the present invention a photosensitive element has also been provided, said element comprising a support and on one or both sides thereof at least one silver halide emulsion layer, comprising silver halide grains prepared in the presence of an oxidizing agent and an organic hole-trapping dopant, said element further comprising silver halide grains composed of at least one halide selected from the group consisting of chloride, bromide and iodide.

Other silver salts which principally can be incorporated in a limited amount in the silver halide lattice are silver phosphate, silver thiocyanate, silver citrate and some other silver salts. The chloride and bromide as halides can be combined between certain ratios in order to form a silver chlorobromide salt. Iodide ions however can be coprecipitated with chloride and/or bromide ions thereby forming a iodohalide with an iodide amount which depends on the saturation limit of iodide in the silver halide lattice with the given halide composition. So up to a maximum amount of about 40 mole percent in silver iodobromide and up to at most 13 mole % in silver iodochloride, both based on silver, can be built in. Preferred silver halide emulsions are silver bromoiodide with not more than 30 mole % of iodide, silver chloroiodide with not more than 8 mole % of iodide and silver chlorobromoiodide with at least 10 mole % of bromide and not more than 4 mole % of iodide.

For certain applications it may be important to apply a well-defined amount of iodide on the crystal surface under controlled conditions in order to get reproducible sensitometric results after image-wise exposure and subsequent processing. This can be done by using an iodide releasing agent as described in EP-A 0 561 415 and in EP-A 0 563 708 and applied on emulsions before, during or after the chemically sensitization in addition to the method and the conditions of the present invention as described hereinbefore.

The composition of the halide present may change in the crystal in a continuous or a discontinuous way. Emulsions containing crystals composed of various sections with different halide compositions are used for several photographic applications. Such a structure with a difference in halide composition between the center and the rest of the crystal (what is called 'core-shell'-emulsion) or with more than two crystal parts differing in halide composition (called a 'band'-emulsion) may occur. Changes in halide composition can be realized by direct precipitation or in an indirect way by conversion where fine silver halide grains of a certain halide composition are dissolved in the presence of the so-called host grains forming a 'shell' or 'band' on the given grain. An emulsion of the present invention can be built up in an almost identical way which is very particular for the emulsions of the present invention wherein the grains can also have a shell or a core which are only distinguished from each other by the presence of the organic hole-trapping dopant according to formula(e) (I) and/or (II) and not by their halide composition as normally found in the emulsions used in the art. Additionally it can be said that the two types of the mentioned core-shell structures may exist in the same grain and do not need to cover each other. However it is important to note that the organic hole-trapping dopant of the present invention may be located at any site in the crystal while the presence in an outermost shell which contains up to 95 percent of the silver in the grains is preferred.

The crystals formed by the methods described above have a morphology which can be tabular or non-tabular. In tabular crystals the aspect ratio (ratio of equivalent circular diameter to thickness) can vary from low (<2) over 'medium' (2 till 8) to high (>8) where, specially in the case of ultrathin tabular crystals high aspect ratios can be realized. The major faces of the formed tabular grains can have a {111} or a {100}-habitus which structures are (respectively) stable or has to be stabilised (for instance by a crystal 'habit modifying agent'). In the class of non-tabular grains there are a lot of possibilities which can be divided in more regularly shaped crystals or crystals with a mixed crystal habit.

A hydrophilic colloid is used as a binder or a protective colloid for the emulsion or any other layer of the photographic material of the present invention. Gelatin is an advantageously used hydrophilic colloid. The preparation of conventional lime-treated or acid-treated gelatin has been descibed in e.g. "The Science and Technology of Gelatin", edited by A. G. Ward and A. Courts, Academic Press 1977, page 295 and following. Gelatin can also be enzyme-treated as described in Bull.Soc.Sci.Phot.Japan, Nr 16, page 30 (1966). Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerisable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch.

Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3), 24(1967) may be used as a dispersion medium. Also the crystal habit restraining agent described in EP-A 0 534 395 may be used.

Part of gelatin may further be replaced by a synthetic or natural high-molecular material.

An interesting substitute for gelatin may be silica as has been described in the published EP-A's 0 392 092, 0 517 961, 0 528 476 and 0 649 051 and 0 704 749. As has been set forth in EP-A 0 528 476 a method of preparing a silver halide light-sensitive photographic material incorporating layers of silver halide precipitated in colloidal silica serving as a protective colloid is given. In this document the silver halides are prepared in colloidal silica, leading to emulsion crystals that are stable at the end of the precipitation, without however having a predictable mean crystal diameter and crystal size distribution. These problems have been overcome as has been described in EP-A 0 682 287, for the preparation of crystals rich in silver chloride, wherein clearly defined circumstances wherein such crystals can be prepared: during the precipitation stage of regular silver chloroiodide crystals amounts of silica sol and of stabilizing onium compound(s), should be optimized in order to avoid uncontrolled formation and growth of aggregates.

The emulsions can be coagulated and washed after precipitation in order to remove the excess soluble salts. These procedures are together with different alternative methods like dia- or ultrafiltration and ion-exchange described in Research Disclosure, item No. 38957, published September 1996, section III.

Additional gelatin or another hydrophilic colloid, suitable as a binder material can be added at a later stage of the emulsion preparation as e.g. after washing, in order to establish optimal coating conditions and/or in order to establish the required thickness of the coated emulsion layer. Preferably a gelatin to silver halide ratio, silver halide being expressed as the equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure item No. 38957, published September 1996, Chapter II.

The silver halide emulsions of the present invention which are prepared in one of the ways described hereinbefore contain crystals which have preferably a spherical equivalent diameter (SED) of more than 0.01 $\mu$m and less than 2 $\mu$m, and more preferably of less than 1.5 $\mu$m. The spherical equivalent diameter (SED) of the crystal represents the diameter of the sphere which has the same volume as the average volume of the silver halide crystals of said emulsion.

The emulsions may be surface-sensitive emulsions which form latent images primarily on the surface of the silver halide grains or they can be emulsions forming their latent-image primarily in the interior of the silver halide grain. The emulsions can further be negative-working emulsions such as surface sensitive emulsions or unfogged internal latent photosensitive emulsions. However direct-positive emulsions of the unfogged, latent image-forming type which are positive-working by development in the presence of a nucleating agent, and even pre-fogged direct-positive emulsions can be used in the present invention.

The sensitization can be carried out in many different ways. There can be a chemical sensitization with a middle chalcogenic compound (as sulfur, selenium and tellurium), gold, a metal of the platinum group of the Periodic System of Elements (like platinum, palladium, rhodium, ruthenium, iridium and osmium) or combinations of these sensitizers which reaction on its turn can be influenced by pAg, pH and temperature of the medium where the chemical sensitization takes place. The chemical sensitization can also be optionally conducted in the presence of e.g. thioether compounds, thiocyanate derivatives, stabilizers, etc. The emulsion can also be sensitized by what is called reduction sensitization as is described already hereinbefore. If desired this can be combined with the aforementioned chemical sensitization methods. A complete description of all the possibilities of sensitization which can be used in the present invention can be found in Research Disclosure, item No. 38957, published September 1996, section IV.

In a next step the silver halide emulsions may be spectrally sensitized with dyes from different classes which include polymethine dyes comprising cyanines, merocyanines, tri-, tetra- and polynuclear cyanines and merocyanines, oxanols, hemioxonols, styryls, merostyryls and so on. In the present invention special attention should given to the use of J-aggregating dyes (see 'The Theory of the Photographic Process', T. H. James ed., $4^{th}$ ed. (1977) p.218–222, and T. Tani in 'Photographic Sensitivity. Theory and Mechanisms', Oxford Univ.Press, New York-Oxford, 1995). These J-aggregating dyes are preferably used in combination with J-aggregating 'tuning'-compounds or -products or -agents. These special 'tuning'-compounds are able to modify the J-aggregate to a certain desired size. These so-called 'J-aggregate-tuning'-compounds are well-known and can be for instance a dye (as described by A. A. Muenter, et al, J.Phys.Chem., 96(1992)2783) or other compounds like alcohols, surfactants, ketones, photographic stabilizers and various other products (see for instance A. H. Herz, Phot.Sci.Eng., 18(1974)323). J-aggregate-tuning compounds which are important and preferably used in the context of the present invention are photographic stabilizers.

In some circumstances one or more spectral sensitizers may be used if a larger part of the spectrum should be covered. Combinations of several spectral sensitizers are sometimes used in order to get supersensitization, which means that in a certain range of the wavelength spectrum the sensitization is more expressed than the sensitization resulting from any concentration of one of the dyes alone or that which would result from an additive effect of dyes. Generally supersensitization can be attained by using selected combinations of spectral sensitizing dyes and other addenda such as stabilizers, development accelerators or inhibitors, brighteners, coating aids, and so on. Special applications as described e.g. in EP-A 0 786 690 , EP-A 0 786 691 and EP-A 0 786 692 can be used in the silver halide emulsion of this inventions. A useful description of various other possibilities in spectral sensitization which may be important with respect to the present invention are found in Research Disclosure, item No. 38957, published September 1996, section V.

The photographic elements comprising the said silver halide emulsions may include various compounds which should play an effective role in the material itself or in the processing after exposure, in finishing or in warehousing the photographic material. These products can be stabilizers and antifoggants. Antifoggants are defined as preventing occurrence of fog while a stabilizer has a function of preserving sensitometric properties. Antifoggants and stabilizers are used in the preparation step, in the storage stage or in the processing stage of the (exposed) photographic material. Antifogging agents and stabilizers can be azoles, mercaptopyrimidines, mercaptotriazines, azaindenes, etc.. Further suitable examples are e.g. those described in Research Disclosure item No. 38957, published September 1996, section VII.

The hydrophilic colloidal layers (silver halide emulsion layer, backing layer, antihalo-layer, etc.) of the photographic material can contain an inorganic or an organic hardening agent (see Research Disclosure item No. 38957, published September 1996, section IIB), brighteners (see Research Disclosure item No. 38957, published September 1996, section VI), light absorbers and scattering materials (see Research Disclosure item No. 38957, published September 1996, section VIII), coating aids (see Research Disclosure item No. 38957, published September 1996, section IXD), antistatic agents (see Research Disclosure item No. 38957, published September 1996, section IXC), matting agents (see Research Disclosure item No. 38957, published September 1996, section IXD) and development modifiers (see Research Disclosure item No. 38957, published September 1996, section XVIII).

The photographic element may further comprise various other additives such as e.g. compounds improving the dimensional stability of the photographic element, ultraviolet absorbers and spacing agents. Suitable additives for improving the dimensional stability of the photographic element are e.g. dispersions of a water-soluble or hardly soluble synthetic polymer e.g. polymers of alkyl(meth) acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α,β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 56-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in Research Disclosure item No. 38957, published September 1996, Section VI, wherein also suitable optical brighteners are mentioned.

Spacing agents may be present of which, in general, the average particle size is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Prior to coating any thickening agent may be used in order to regulate the viscosity of the coating solution, provided that they do not particularly affect the photographic characteristics of the silver halide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No.

558.143 and JP-A's 53-18687 and 58-36768. Negative effects on physical stability possibly resulting from the addition of polymeric compounds can be avoided by exclusion of those compounds and by restricting extra additions of colloidal silica.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups. Hardeners may be added to the antistress layer, covering one or more light-sensitive silver halide emulsion layers before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts as e.g. chromium acetate and chromium alum, aldehydes e.g. formaldehyde, glyoxal, and glutaraldehyde, N-methylol compounds as e.g. dimethylolurea and methyloldimethylhydantoin, dioxan derivatives as e.g. 2,3-dihydroxydioxan, active vinyl compounds as e.g. 1,3,5-triacryloyl-hexa-hydro-s-triazine, active halogen compounds as e.g. 2,4-dichloro-6-hydroxy- s-triazine, and mucohalogenic acids as e.g. mucochloric acid and mucophenoxy-chloric acid. These hardeners can be used alone or in combination. The binders can also be hardened with fast-reacting hardeners such as carbamoylpyridinium salts. Formaldehyde and phloroglucinol can e.g. be added respectively to the protective layer(s) and to the emulsion layer(s). Further suitable possibilities for hardening can be found in Research Disclosure item No. 38957, published September 1996, section IIB.

The photographic elements may be coated on a variety of supports which can be flexible or rigid. The flexible materials include plastic films and papers while the rigid materials include glass, metals, etc. The surface of the support is generally subjected to undercoating treatment (like corona discharge, irradiation with ultraviolet rays, etc) in order to enhance the adhesion of the silver halide emulsion layer (see Research Disclosure item No. 38957, published September 1996, section XV and the references cited therein). The photographic elements can be exposed to actinic radiation, especially in the visible, near-ultraviolet and near-infrared region of the spectrum, in order to form a latent image (see Research Disclosure item No. 38957, published September 1996, section XVI).

Various exposure means can be employed for exposure of the photographic material of the invention. As a light source, any optional (light) source releasing a radiation corresponding to the sensitivity wavelength of the photographic material can be employed. Examples of the light sources generally used include natural light, incandescent lamp, halogen lamp, mercury lamp, fluorescent lamp and all types of flash light sources. Light sources that emit light in the ultraviolet to infrared region can also be used as recording light sources. Photographic materials can for example also be exposed to gas lasers, semiconductor lasers, light emitting diodes or plasma light sources. In the same way the material can be exposed to a LCD-'light source' or to a fluorescent surface given by a phosphor stimulated with X-rays or electron rays. Direct X-rays, β- or γ-rays are included as possible radiation sources in the present invention.

The latent-image formed in the silver halide crystals after exposure can be processed in order to form a visible image. Therefore various methods are known and many developing, fixing and stabilizing agents are described for the formation of photographic silver image. The know-how for processing photographic silver halide materials which principally can be used in relation with the present invention has been described in Research Disclosure, items Nos. 176043, published December 1978, sections XIX to XXIV and Research Disclosure item No. 38957, published September 1996, section XIX.

In the conventional way of processing most of the materials are developed by means of a liquid containing hydroquinone as main developing agent usually in combination with a so-called auxiliary developer. In a alternative way of processing hydroquinone is incorporated in the photographic material itself while the processing liquid is a mere alkaline solution. However it is important in order to realize that hydroquinone is suspect in various ways, especially in an ecological and medical point of view. The present invention is also related with a more ecological way of processing where hydroquinone is at least partly replaced by ascorbic acid as a developing agent. Ascorbic acid should be interpreted in a broad sense and includes ascorbic acid isomers, derivatives, salts and analogous compounds (including some reductones and reductic acid derivatives). The most preferred compounds are (l-)ascorbic acid, iso-ascorbic, reductic acid and their salts. Useful combinations of developers containing an ascorbic acid developing agent which should be preferably used in the scope of the present invention is described for many applications (in graphics, radiography, etc) in Research Disclosure, item No. 37152, published Mar. 1, 1995, pages 185–224.

The photographic emulsions according to the present invention can also be used in multi-layered multicolor materials. These materials comprise a support and two or more silver halide emulsion layers that have different spectral sensitivities. The multi-layered color photographic material generally comprises at least one red-sensitive emulsion layer, at least one green-sensitive emulsion layer and at least one blue-sensitive emulsion layer on a support. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer in order to enhance the sensitivity.

The silver halide material can also contain different types of couplers which can be incorporated in color photographic materials. The red-sensitive emulsion layer contains generally a cyan coupler, the green-sensitive layer generally contains a magenta coupler and the blue-sensitive emulsion layer generally contains a yellow coupler. All information which can be important for the application of the present invention in these type of materials is extensively described in Research Disclosure item No. 38957, published September 1996, section X. More information with respect to various color applications which also belong to the scope of the present invention, can also be found in U.S. Pat. No. 5,532,120.

Processing required in order to form a visible dye image for color materials means contacting the element with a color developing agent in order to reduce developable silver halide and to oxidize the color developing agent which in turn normally reacts with a coupler in order to form a dye (see Research Disclosure item No. 38957, published September 1996, section XX).

Special attention should be paid to photothermographic applications which should not be neglected in the context of the present invention. In this type of materials a photosensitive agent is present which after exposure to UV, visible or IR light is capable of catalyzing or participating in a thermographic process bringing about changes in optical density or color. Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker, 1991.

A photo-addressable thermosensitive element normally comprises photosensitive silver halide, a reducing agent for silver ions and a binder. The thermosensitive element may further comprise a substantially light-insensitive organic silver salt in catalytic association with the photosensitive silver halide and in thermal working relationship with the reducing agent for silver ions. The element may comprise a layer system with the silver halide in catalytic association with the substantially light-insensitive organic silver salt ingredients, a spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt, i.e. during the thermal development process the reducing agent and the toning agent, if present, are able to diffuse to the substantially light-insensitive organic silver salt, e.g. a silver salt of a fatty acid. It is the purpose of the present invention to provide a photo-sensitive image-forming element, wherein said element is a photo-adressable thermographic element, comprising a substantially light-insensitive organic silver salt, an organic reducing agent therefor in thermal working relationship therewith and a binder.

If the photosensitive silver halide grains of the present invention described hereinbefore are employed together with a substantially light-insensitive organic silver salt it is used in a range of 0.1 to 90 mole % of substantially light-insensitive organic silver salt, preferably in the range from 0.2 to 50 mole %, more preferably from 0.5 to 35 mole % and most preferably in the range from 1 to 12 mole % of said subtantially light-insensitive organic silver. Preferred substantially light-insensitive organic silver salts are silver salts of organic carboxylic acids in particular aliphatic carboxylic acids known as fatty acids wherein the aliphatic carbon chain has preferably at least 12 C-atoms, e.g. silver laurate, silver palmitate, silver stearate, silver hydroxystearate, silver oleate and silver behenate, which silver salts are also called "silver soaps", silver dodecyl sulphonate described in U.S. Pat. No. 4,504,575 and silver di-(2-ethylhexyl)-sulfosuccinate described in EP-A 0 227 141. Modified aliphatic carboxylic acids with thioether groups as described e.g. in GB-A 1,111,492 and other organic silver salts as described in GB-A 1,439,478, e.g. silver benzoate and silver phthalazinone, may be used likewise in order to produce a thermally developable silver image. Further are mentioned silver imidazolates and the substantially light-insensitive inorganic or organic silver salt complexes described in U.S. Pat. No. 4,260,677.

A suspension of particles containing a substantially light-insensitive organic silver salt may be obtained by using a process comprising simultaneously metered addition of an aqueous solution or suspension of an organic carboxylic acid or its salt and an aqueous solution of a silver salt to an aqueous liquid as described in EP-A 0 754 969.

The silver halide emulsion grains described hereinbefore may be added to the photo-addressable thermally developable element in any way which places it in catalytic proximity to the substantially light-insensitive organic silver salt. Silver halide and the substantially light-insensitive organic silver salt being separately formed (i.e. ex-situ or "preformed") in a binder can be mixed prior to use to prepare a coating solution, but it is also effective to blend both of them for a long period of time which is especially important in cases where tabular silver halide grains are present so that an intimate contact with the large specific surface of said tabular grains is realized. Furthermore, it is effective to use a process which comprises adding a halogen-containing compound to the organic silver salt to partially convert the substantially light-insensitive organic silver salt into silver halide as disclosed in U.S. Pat. No. 3,457,075.

It should be noted that a point of interest of the present invention is the presence of an organic hole-trapping dopant according to the formula(e) (I) and/or (II) and, if desired, an electron trapping dopant in the organic silver salt material or even incorporated in the organic silver salt grains. As already mentioned for the silver halide crystals it can also be a combination of an organic hole-trapping dopant represented by formula(e) (I) and/or (II) and one or more electron trapping dopant(s). In the same way as described for silver halide grains this way of doping can additionally be combined with addition of a dopant of another group.

A particularly preferred mode of preparing the emulsion of organic silver salt and photosensitive silver halide for coating the photo-addressable thermally developable element from solvent media according to the present invention is disclosed in U.S. Pat. No. 3,839,049, but other methods such as those described in Research Disclosure, June 1978, item 17029 and U.S. Pat. No. 3,700,458 may also be used for producing the emulsion. Another particularly preferred mode of preparing the emulsion of organic silver salt and photosensitive silver halide for coating the photo-addressable thermally developable element from aqueous media according to the present invention is disclosed in WO97/48014, which discloses a production method for a photothermographic recording material comprising the steps of: (i) providing a support; (ii) coating the support with a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterised in that the photosensitive silver halide is formed by reacting an aqueous emulsion of particles of the substantially light-insensitive organic silver salt with at least one onium salt with halide or polyhalide anion(s) and that the photo-addressable thermally developable element is coated from an aqueous dispersion medium.

Suitable organic reducing agents for the reduction of the substantially light-insensitive organic silver salts in photo-addressable thermosensitive elements are organic compounds containing at least one active hydrogen atom linked to O, N or C, such as is the case with mono-, bis-, tris- or tetrakis-phenols, mono- or bis-naphthols, di- or polyhydroxy-naphthalenes, di- or polyhydroxybenzenes, hydroxymonoethers such as alkoxynaphthols, e.g. 4-methoxy-1-naphthol described in U.S. Pat. No. 3,094,41; pyrazolidin-3-one type reducing agents, e.g. PHENIDONE (tradename), pyrazolin-5-ones, indan-1,3-dione derivatives, hydroxytetrone acids, hydroxytetronimides, 3-pyrazolines, pyrazolones, reducing saccharides, aminophenols e.g. METOL (tradename), p-phenylenediamines, hydroxylamine derivatives such as for example described in U.S. Pat. No. 4,082,901, reductones e.g. ascorbic acids, hydroxamic acids, hydrazine derivatives, amidoximes, n-hydroxyureas and the like; see also U.S. Pat. Nos. 3,074,809, 3,080,254, 3,094,417 and U.S. Pat. No. 3,887,378.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent.

During the thermal development process the reducing agent must be present in such a way that it is able to diffuse to the photosensitive silver halide and, if present, the substantially light-insensitive organic silver salt particles so that reduction thereof can take place.

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. No. 3,460,946 and 3,547,648.

The film-forming binder for the photo-addressable thermosensitive element according to the present invention may be coatable from a solvent or aqueous dispersion medium.

In case the film-forming binder for the photo-addressable thermosensitive element is coatable from a solvent dispersion medium according to the present invention, all kinds of natural, modified natural or synthetic resins or mixtures of such resins in which the organic silver salt can be dispersed homogeneously may be used; e.g. polymers derived from a,b-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed by MONSANTO USA under the trade names BUTVAR• B76 and BUTVART™ B79 and provides a good adhesion to paper and properly subbed polyester supports.

The film-forming binder for the photo-addressable thermosensitive developable element coatable from an aqueous dispersion medium according to the present invention may be all kinds of transparent or translucent water-dispersible or water soluble natural, modified natural or synthetic resins or mixtures of such resins in which the organic silver salt can be dispersed homogeneously, for example proteins such as gelatin and gelatin derivatives (e.g. phthaloyl gela-tin), cellulose derivatives such as carboxymethylcellulose, polysaccharides such as dextran, starch ethers, galactomannan, polyvinyl alcohol, polyvinylpyrrolidone, acrylamide polymers, homo- or copolymerized acrylic or methacrylic acid, latexes of water dispersible polymers, with or without hydrophilic groups, or mixtures thereof. Polymers with hydrophilic functionality for forming an aqueous polymer dispersion (latex) are described in U.S. Pat. No. 5,006,451, but serve therein for forming a barrier layer preventing unwanted diffusion of vanadium pentoxide present as an antistatic agent.

The binder to organic silver salt weight ratio is preferably in the range of 0.2 to 6, while the thickness of the photo-addressable thermally developable element is preferably in the range of 5 to 50 $\mu$m.

The above mentioned binders or mixtures thereof may be used in conjunction with waxes or "heat solvents", also called "thermal solvents" or "thermosolvents", improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A's 0 119 615 and 0 122 512 and DE-A 3 339 810.

The photo-addressable thermosensitive material comprising said substantially light-insensitive organic silver salt and said light-sensitive silver halide crystals may include various other compounds which should play a role of interest in the material itself or afterwards as e.g. in the processing, finishing or conservation stage of the material.

These compounds can be 'toning agents', also stabilizers and anti-foggants, surfactants (specially for coating photo-addressable thermosensitive elements from aqueous media), anti-halation dyes and other additives (like free fatty acids, antistatic agents, surface active agents, etc.) that are described in EP-A 0 844 514.

The support used for the photo-addressable thermosensitive material, the function and composition of the protective and antistatic layers, the coating of the various layers of the photothermographic recording material are disclosed in the same EP-A 0 844 514.

The foregoing description is also comprising all the elements of the method for preparing the photosensitive element of the present invention. This can be summarized as the method for preparing a photosensitive element comprising a support and on one or both sides thereof at least one silver halide emulsion layer, containing silver halide grains the precipitation of which has been performed in the presence of an organic hole-trapping dopant according to formula(e) (I) and/or (II). The said precipitation has to be performed in the presence of a oxidizing agent which is preferably p-toluene thiosul-phonic acid and in well-defined conditions which is clearly described hereinbefore.

The invention is described hereinafter by way of the following examples, without however being limited thereto.

EXAMPLES

The examples described hereinafter will clearly illustrate the advantages which can be realized with the method described in the present invention.

For the preparation of the core-shell emulsions which are used in the next examples the following solutions were prepared:

solution (1): containing 500 grams of silver nitrate in 1 liter of demineralized water;

solution (2a): containing 231.6 grams of sodium chloride in 1 l of demineralized water;

(2b): containing 349.9 grams of potassium bromide in 1 l of demineralized water;

solution (3): containing 75 grams of an inert gelatine in 1.5 l demineralized water.

solution (4): containing 0.15 grams of sodium formiate in 1 l demineralized water.

Example 1

Preparation of the Emulsions (a) Nucleation Phase

After raising the temperature of solution (3) to 50° C. the pAg as adjusted to 7.4 with a 2.94 molar silver nitrate solution and the pH to 2.8 with a 1 molar sulphuric acid solution. Then the solutions (1) and (2a) were introduced by using the double jet technique into solution (3) during 300 seconds with a flow rate of 7.75 ml per minute while keeping the pAg constant at 7.4.

(b) Growth Phase—$1^{rst}$ Step

Then the double jet precipitation was continued by introducing the solutions (1) and (2a) during 2888 seconds in the foregoing precipitate which was kept at 50° C. The flow rate was then linearly increased from 7.75 ml per minute at the start till 60 ml per minute at the end of the precipitation while keeping the pAg always at 7.4.

The emulsion was then ultrafiltrated on a selective permeability membrane for salts and water while the pAg was kept at the same value of 7.4. After filtration the emulsion was further peptized and stored for a short time. Gelatine was then added in order to bring the emulsion on a gelatin to silver ratio of 0.5 (where silver was expressed as silver nitrate) which was followed by a short periode of stirring to get a good gelatin dispersion and the addition of a small amount of a phenolic solution as a biocide in favour of preservation.

The emulsion which was made in this way contained monodisperse cubic grains with a mean volumetric diameter of 0.37 $\mu$m. After adding 500 ml of demineralized water to 650 grams of the emulsion the amount of silver nitrate was 85 gram per kilogram of the emulsion. After bringing the temperature to 50° C. the pAg was adjusted to 3.6 by using a concentrated silver nitrate solution and the pH was adjusted to 4.8 with a 0.4 molar sodium hydroxide solution. Then 150 ml of a $4.76.10^{-3}$ molar solution of sodium p-toluene thiosulphonate was added per mole of silver nitrate.

(c) Growth Phase—$2^{nd}$ Step

In this precipitation step a triple jet procedure was followed wherein the thickness of the shell was as close as possible to 50 nm so that the total mean volumetric grain thickness was 0.42 $\mu$m. The three solutions (1), (2a) and (4) were injected together in the diluted core-emulsion so that the silver nitrate solution (1) had a constant flow rate of 30 ml per minute during 316 seconds while keeping the pAg adjusted at 3.6. Solution (4) was added only 300 seconds (same start moment) with a flow rate of 10 ml per minute, which was kept constant during this precipitation step.

After cooling the emulsion to 40° C. the weight ratio of gelatine over silver nitrate was adjusted to 0.5 by adding the same type of inert gelatine. The resulting emulsion contained 115 grams of silver nitrate per kilogram.

(d) Chemical Sensitization

The emulsions were then redispersed and diluted with demineralized water and after adjusting the pAg and pH respectively to 7.16 and 5.5 at the temperature of 50° C. the following compounds were added (per 35 gram of silver nitrate):

–2.8 ml of a diluted surfactant solution and 3.5 ml of a $4.76*10^{-3}$ molar solution of sodium p-toluenethiosulphonic acid which after 13 minutes was sequentially followed by –0.84 ml of a $8*10^{-5}$ molar sodium thiosulphate solution, –1.75 ml of a solution containing $1.456*10^{-3}$ mole/l $AuCl_4.4H_2O$ and $1.58*10^{-2}$ mole/l $NH_4CNS$, –2.10 ml of a 0.396 molar sodium sulphite solution. The chemical sensitization was carried out till an optimal sensitivity was reached.

Coating Procedure

After cooling to 40° C. the ripened emulsion was adjusted at a weight ratio of gelatine over silver nitrate of 1.0. Then a well defined amount of a triazaindolizine derivative for stabilization and several wetting agents were added before coating the emulsion on a polyethylene terephtalate support. The amount of silver nitrate was 2.0 grams per $m^2$.

Exposure and Processing

The coated emulsions were then exposed during $10^{-2}$ seconds through a step wedge (constant=0.1) with a XENON-lamp. The development was carried out in a G150-bath during 1 minute, followed by a 1 minute fixation step in a G333-bath (which was diluted with 4 parts of water for one part G333) and a 1 minute washing step in demineralized water. All the processing steps were carried out at room temperature. G130 and G333 are tradenames from AGFA-GEVAERT N.V. The density which was realized after processing as a function of the light dose was measured and used to determine the following parameters:

the fog level $D_{min}$, the maximum density $D_{max}$,

'Chemical Sens.': this column gives information about whether or not the emulsion was chemical sensitized (±), the 'Doped'-column shows if the emulsion is doped and by which compound of the present invention, while the 'Dopant amount'-column gives the amount of said dopant in ppm which is expressed as mole of the dopant per mole silver nitrate of the emulsion; the given amount is the quantity which is added during the grain precipitation phase;

the sensitivity $S_{0.1>fog}$ is measured as the amount of light (expressed in log(It)-units) necessary to get a density of 0.1 above fog level, the sensitivity $S_{0.5>fog}$ measured as the amount of light (expressed in log(It)-units) necessary to get a density of 0.5 above fog level; the sensitivity value of $S_{0.1>fog}$ and $S_{0.5>fog}$ means that a decrease of 0.3 is a sensitivity increase by a factor 2.

TABLE 1

Sensitometric results of (un)doped AgCl-emulsions.

| Nr. | Chemical Sens. (+/−) | Doped | Dopant amount (ppm) | $D_{min}$ | $D_{max}$ | $S_{0.1>fog}$ | $S_{0.5>fog}$ | Note |
|---|---|---|---|---|---|---|---|---|
| 1 | − | — | — | 0.04 | 0.67 | 1.74 | 2.14 | reference |
| 2 | − | HCOONa | 100 | 0.03 | 0.75 | 1.38 | 1.62 | invention |
| 3 | − | $CH_3COONa$ | 100 | 0.03 | 0.73 | 1.59 | 1.86 | invention |
| 4 | + | — | — | 0.03 | 0.71 | 1.34 | 1.55 | reference |
| 5 | + | HCOONa | 100 | 0.05 | 0.75 | 1.00 | 1.21 | invention |

The results summarized in Table 1 very clearly demonstrate that the AgCl-emulsions which are doped with the compounds according to formula (I) of the present invention give an increase in sensitivity and in covering power as well. This was found for both the chemically unsensitized as for the sensitized AgX-emulsions.

Example 2

For this experiment only AgBr-emulsions were used instead of the described AgCl-emulsions of the foregoing example. For the preparation and evaluation of pure AgBr-emulsions with the same dimensions exactly the same methods and doping products were applied as for the AgCl-emulsions. In this case solution (2b) instead of ion (2a) is used together with solution (1).

For the formation of the shell in the $2^{nd}$ step of the growth phase the triple jet precipitation was carried out during 450 seconds with a flow rate of solution (1) of 20 ml per minute while the pAg was kept at 3.6. Solution (4) was only added for 375 seconds started at the same moment with a flow rate of 8 ml/min.

The resulting emulsion contained about 140 grams of silver nitrate per kilogram of emulsion.

The sensitometric results for the AgBr-emulsions are summarized in Table 2 where the headings have the same significance as in Table 1.

TABLE 2

Sensitometric results of (un)doped AgBr-emulsions.

| Nr. | Chem. Sens. (+/−) | Doped | Dopant amount (ppm) | $D_{min}$ | $D_{max}$ | $S_{0.1>fog}$ | $S_{0.5>fog}$ | Note |
|---|---|---|---|---|---|---|---|---|
| 1 | − | — | — | 0.03 | 1.04 | 0.81 | 1.03 | reference |
| 2 | − | HCOONa | 50 | 0.03 | 0.77 | 0.43 | 0.82 | invention |
| 3 | − | HCOONa | 100 | 0.04 | 0.95 | 0.16 | 0.60 | invention |
| 4 | − | $CH_3COONa$ | 100 | 0.03 | 0.77 | 0.70 | 0.86 | invention |
| 5 | + | — | — | 0.10 | 1.01 | 0.42 | 0.61 | reference |
| 6 | + | HCOONa | 100 | 0.11 | 1.03 | 0.11 | 0.31 | invention |

As shown for AgCl the results in Table 2 are also a clear demonstration that the use of the compounds according the present invention as organic hole-trapping dopants in AgBr-emulsions give also rise to a substantial increase in sensitivity.

Example 3

Preparation of the Emulsion

The emulsion which was made in a similar way as described in example 1, from step a) to c), contained monodisperse cubic grains with a mean volumetric diameter of 0.42 μm. 395 g of this emulsion was added to 606 ml of demineralized water so that the amount of silver nitrate was 50 g Ag per kilogram of the emulsion. After bringing the temperature at 50° C. the pAg was adjusted to 7.14 by using a concentrated silver nitrate solution. Further the emulsion was redispersed and spectrally sensitized with a green light-absorbing sensitizer (with or without tetrazaindene as stabilizer), ripened during 30 minutes at a pAg and pH equal to 7.14 and 4.8 respectively and at 38° C. Then the emulsion was coated together with several wetting agents on a polyethylene terephtalate support in an amount of 1.5 g per $m^2$.

Exposure and Processing

Samples were exposed with xenon lamp during $10^{-2}$ sec through a step wedge (Edgerton constant=0.15) and through the interference filter V405 and the cut-off filter L477. The exposed photographic materials were developed during 8 minutes in a metol-ascorbic acid bath (as defined by James, Vanselow and Quirk in Phot.Sci.Technol.,19B(1953) p.170) followed by a 1 minute fixation step in a G333-bath (which was diluted with 4 parts of demineralized water for one part G333) at room temperature and a 1 minute washing step in demineralized water (G333 is a trade mark produkt from AGFA-GEVAERT).

The results listed in Table 3 describe the following parameters:

$D_{min}$ is the fog level (expressed with an accuracy of 0.01);

$D_{max}$ is the maximum density (expressed with an accuracy of 0.01),

Sens (0.2>fog) means the sensitivity in log(It)—units which is realised at a density of 0.2 above fog level, Sens(80%$D_{max}$) means the sensitivity in log(It)—units which is realized at 80% of the maximal density, Table 3 summarizes the sensitometric results of AgBr cubic grains (doped with 1 ppm formate) of 0.42 μm, spectrally sensitized with a green light-absorbing sensitizer:

in monomeric form (20% SGSC=specific grain surface coverage), in aggregate form (80% SGSC)

in aggregate form (80% SGSC) in the presence of tetrazaindene (=TAI) as stabilizer.

TABLE 3

The influence of formate-dopant in spectrally sensitized AgBr-crystals

| | $D_{min}$ | $D_{max}$ | Sens (0.2 > fog) | Sens (80% $D_{max}$) | |
|---|---|---|---|---|---|
| Monomeer | | | | | |
| Exposure V405 | | | | | |
| Ref. em. + 20% SGSC | 0.034 | 0.77 | 3.03 | 3.34 | reference |
| formate + 20% SGSC | 0.029 | 0.76 | 2.32 | 2.68 | invention |
| Exposure L477 | | | | | |
| Ref. em. + 20% SGSC | 0.029 | 0.78 | 2.67 | 3.12 | reference |
| formate + 20% SGSC | 0.031 | 0.85 | 1.62 | 2.11 | invention |
| Aggregate | | | | | |
| Exposure V405 | | | | | |
| Ref. em. + 80% SGSC | 0.030 | 0.78 | 3.28 | 3.58 | reference |
| formate + 80% SGSC | 0.031 | 0.78 | 2.30 | 2.60 | invention |
| Exposure L477 | | | | | |
| formate + 80% SGSC | 0.031 | 0.77 | 1.30 | 2.98 | invention |
| Ref. em. + 80% SGSC | 0.030 | 0.79 | 2.55 | 1.83 | reference |
| Aggregate + TAI | | | | | |
| Exposure v405 | | | | | |
| Ref. em. + 80% SGSC | 0.030 | 0.77 | 3.11 | 3.52 | reference |
| formate + 80% SGSC | 0.034 | 0.78 | 2.35 | 2.70 | invention |
| Exposure L477 | | | | | |
| Ref. em. + 80% SGSC | 0.029 | 0.78 | 2.33 | 2.81 | reference |
| formate + 80% SGSC | 0.034 | 0.77 | 1.11 | 1.62 | invention |

From the results presented in Table 3 it can be concluded that doping the emulsion with the organic hole-trapping agent according to the formula (I) of the present invention gives a very strong increase in sensitivity by illuminating with light which is absorbed by silver halide itself. This increase is almost independent of the structure of the spectral sensitizer present at the grain surface.

Illumination with light which is specifically absorbed by the spectral sensitizer gives an increase of sensitivity which is even larger than the forementioned increase. The effect realized with the hole-trapping agent of the present invention is largest for the emulsion containing the spectral sensitizer in the aggregated form. As can be seen a further increase in sensitivity can be realized if a photographic stabilizer like tetra-azaindene is used together with the spectral sensitizer when present on the grain surface in aggregated form.

Example 4

For the preparation of the core-shell emulsion containing 100 p.p.m. of rongalite (see compound II.1 hereinbefore in the detailed description) used in the present example, the following solutions were prepared:

solution (1): containing 500 grams of silver nitrate in 1 liter of demineralized water;

solution (2): containing 349.9 grams of potassium bromide in 1 liter of demineralized water;

solution (3): containing 50 grams of an inert gelatin in 1 l of demineralized water.

solution (4): containing 0.372 grams of rongalit in 1 l of demineralized water.

Emulsion Preparation (a) Nucleation Step

After raising the temperature of solution (3) to 63° C. pAg was adjusted to 6.9 with solution (2) and pH to 2.8 with a 0.3 molar of sulphuric acid solution. Then the solutions (1) and (2) were introduced by using the double jet technique into solution (3) during 300 seconds with a flow rate of 0.87 ml per minute while keeping the pAg constant at 6.9.

(b) Neutralization Step

Solution (2) was introduced during 2 seconds with a flow rate of 10 ml per minute in order to adjust pAg to a value of 7.8.

(c) First Growth Step

Double jet precipitation was continued by introducing the solutions (1) and (2) during 8414 seconds in the reaction vessel which was kept at 63° C. The flow rate was then linearly increased from 0.87 ml per minute at the start till 13.33 ml per minute at the end of the precipitation while keeping the pAg always at 7.8.

The emulsion was ultrafiltrated on a selective permeability membrane for salts and water while the pAg was kept at the same value of 7.8. After filtration the emulsion was further peptized and stored for a short time. Gelatin was then added in order to bring the emulsion on a gelatin to silver ratio of 0.5 (silver being expressed as silver nitrate). This addition was followed by a short period of stirring in order to get a homogeneous gelatin dispersion and addition of a small amount of an aqueous solution of phenol, acting as a biocide.

The thus prepared emulsion was containing monodisperse cubic silver bromide grains haivng a mean volumetric diameter of 0.40 $\mu$m. After adding 650 ml of demineralized water to 650 grams of the emulsion the amount of silver nitrate was about 100 gram per kilogram of the emulsion.

After bringing the temperature to 50° C. the pAg was adjusted to 4.15 making use therefor from a concentrated silver nitrate solution and the pH was adjusted to 4.8 with a 0.3 molar solution of sulphuric acid. Then 25 ml of a 4.76 mmolar solution of sodium p-toluene thiosulphonate was added per mole of silver nitrate. The core emulsion thus obtained was divided into 4 equal parts called A, B, C and D.

(d) Second Growth Step

In this precipitation step a triple jet procedure was followed wherein the thickness of the shell was as close as possible to 50 nm so that the total mean volumetric grain thickness was 0.45 $\mu$m. The three solutions (1), (2) and (4) were injected together in the diluted core-emulsions B and D so that the silver nitrate solution (1) had a constant flow rate of 20 ml per minute during 450 seconds while keeping pAg adjusted at 4.15 and 6.65 respectively. Solution (4) was simultaneously added during 375 seconds with a constant flow rate of 8 ml per minute for the said parts B and D. The same was performed for the parts A and C, except for the addition of rongalit solution (4).

After cooling the emulsion parts A, B, C and D to 40° C. the weight ratio of gelatin to silver nitrate was adjusted to 0.5 by adding the same type of inert gelatin. The resulting emulsion was containing 124 grams of silver nitrate per kilogram.

the fog level $D_{min}$, the maximum density $D_{max}$,

'Sens.1': gives information about the sensitivity measured at a density of 0.2 above fog, 'Sens.2': gives information about the sensitivity measured at 80% of the maximum density, wherein both sensitivities are measured as amounts of light (expressed in log(Exposure)-units) required in order to get the desired density as: a decrease of 0.3 thus corresponds with a sensitivity increase by a factor 2.

The results summarized in the Table 4 hereinafter are demonstrating very clearly that the silver bromide emulsions which are doped with the rongalite compound II.1 according to the formula (II) of the present invention give an increase in sensitivity, even without addition of chemically sensitizing agents. Materials coated from emulsions doped according to the present invention with rongalite compound II.1 as organic hole trapping agent (see inventive Emulsions B and D) are thus more sensitive than the comparative Emulsions A and C; even when no chemical ripening agents are added to the emulsions as can be concluded from the sensitivities measured at a density of 0.2 above fog. The lower sensitivity for Emulsion B at a density of 0.8 times Dmax is obviously due to the lower pAg value which was maintained during shell precipitation.

TABLE 4

Sensitometric results of chemically unripened emulsions having cubic silver bromide crystals.

| Material | Doped | Dopant amount (ppm) | pAg (shell) | $D_{min}$ | $D_{max}$ | $S_{0.2>fog}$ | $S_{0.8\cdot Dmax}$ |
|---|---|---|---|---|---|---|---|
| A (comp) | — | — | 4.15 | 0.025 | 0.49 | 3.13 | 3.45 |
| B (inv) | NaOCSO2 | 100 | 4.15 | 0.030 | 0.65 | 2.83 | 3.75 |
| C (comp) | — | — | 6.65 | 0.029 | 0.65 | 3.06 | 3.45 |
| D (inv) | NaOCSO2 | 100 | 6.65 | 0.029 | 0.73 | 2.54 | 2.91 |

Coating Procedure

After cooling to 40° C. the emulsion parts A to D were adjusted at a weight ratio of gelatin to silver nitrate of 1.27 by adding additional amounts of gelatin. Then triazaindolizine as stabilizing agent, wetting and hardening agents were added before coating the emulsion parts A–D on a polyethylene terephthalate support. The amounts of silver nitrate were about 1.23; 1.45; 1.51 and 1.35 grams per $m^2$ for each of the Materials A, B, C and D respectively.

Exposure and Processing

The coated Materials A–D were exposed during $10^{-2}$ seconds through a step wedge (Samples were exposed with XENON-lamp during $10^{-2}$ sec through a step wedge (Edgerton constant=0.15) and through the interference filter V405 which was used for exposure in the intrinsic optical absorption region. The exposed photographic materials were developed during 8 minutes in a metol-ascorbic acid bath (as defined by James, Vanselow and Quirk in Phot.Sci.Technol., 19B(1953) p.170) followed by a 1 minute fixation step in a G333-bath (which was diluted with 4 parts of demineralized water for one part G333) at room temperature and a 1 minute washing step in demineralized water (G333 is a trade mark produkt from AGFA-GEVAERT).

All the processing steps were carried out at room temperature. G333® is a tradename from Agfa-Gevaert N.V. The density which was realized after processing as a function of the light dose was measured and used to determine the following parameters:

Chemical Sensitization

After adjusting the pAg and pH respectively to 7.32 and 5.5 at the temperature of 40° C. the following compounds were added (per 35 grams of silver nitrate):

1.75 ml of diluted surfactant solution and 3.5 ml of a 4.76 mmolar solution of sodium p-toluene thiosulphonic acid which, after 13 minutes of digestion time, was sequentially followed by addition of 0.84 ml of a $8.10^{-5}$ molar solution of sodium thiosulphate, 1.75 ml of a solution containing $1.456.10^{-3}$ mole/l of $HAuCl_4.4H_2O$ and $1.58.10^{-2}$ mole/l of $NH_4CNS$, 2.10 ml of a 7.93 $\mu$molar solution of sodium sulphite.

Chemical sensitization was carried out at 60° C. until an optimized sensitivity was reached. For the materials A', B', C' and D' having been coated with the chemically ripened Emulsions A–D data as given in Table 4 are summarized in Table 5.

It should be noted that exposure was performed within 0.06 s through a step wedge having a density of D=1 and a constant of 0.15 with a XENON-lamp A V405 filter which was used for exposure in the intrinsic optical absorption region. The development was carried out in a G150®-developer (dilution: 1+5) during 2 minutes at 23° C., followed by a fixation step in a G335®-bath during 2 minutes and a washing step in demineralized water of 23° C. taking 2 minutes. G150® and G335® are both trade names from Agfa-Gevaert N.V.

TABLE 5

Sensitometric results of chemically ripened emulsions having cubic silver bromide crystals.

| Material | Doped | Dopant amount (ppm) | pAg (shell) | $D_{min}$ | $D_{max}$ | $S_{0.2>fog}$ | $S_{0.8*Dmax}$ |
|---|---|---|---|---|---|---|---|
| A' (comp) | — | — | 4.15 | 0.007 | 4.00 | 1.32 | 1.66 |
| B' (inv) | NaOCSO2 | 100 | 4.15 | 0.010 | 4.00 | 1.24 | 1.56 |
| C' (comp) | — | — | 6.65 | 0.005 | 4.00 | 1.65 | 1.94 |
| D' (inv) | NaOCSO2 | 100 | 6.65 | 0.021 | 3.97 | 1.32 | 1.65 |

As can be concluded from the results obtained from Table 5, chemically ripened Emulsions A'–D' coated as the corresponding Materials have an enhanced maximum density if compared with the unripened emulsions from Table 4, but the emulsions, doped with an organic hole trapping agent as rongalit, show a clearly enhanced sensitivity at low as well as at high densities. A gain in sensitivity of up to a factor 2 is measured indeed, if e.g. Materials C' and D' (both having a pAg during shell precipitation) are compared with each other.

Having described in detail preferred embodiments of the current invention, it will now be apparent to those skilled in the art that numerous modifications can be made therein without departing from the scope of the invention as defined in the following claims.

What is claimed is:

1. A method for preparing a photosensitive element comprising a support and on one or both sides thereof at least one silver halide emulsion layer, comprising silver halide grains precipitated in the presence of an organic hole-trapping dopant represented by formula (I) or (II), wherein formula (I) corresponds to a structure as follows:

R—COOM (I)

wherein

R represents hydrogen, an alkyl group, an aryl group, an aralkyl group or hetero-aryl group, and wherein M is hydrogen or any metal or organic group which can form a salt; and wherein formula (II) corresponds to a structure as follows:

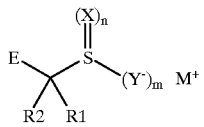

(II)

wherein:

X and Y are independently selected from O, S, Se;

m is 1 and n is 1 or 2;

R1 and R2 each independently represents hydrogen, an alkyl group, an aryl or aralkyl group or a heteroaryl group, wherein R1 and R2 may be the same or different and may form a ring;

E represents a group linked to the carbon atom by a heteroatom, having at least one free electron pair;

$M^+$ is a proton or an organic or inorganic counterion; and said organic hole-trapping dopant being introduced during precipitation of the silver halide grains via the silver salt inlet or via a separated third inlet system.

2. A method according to claim 1, wherein an oxidizing agent is present together with said organic hole-trapping dopant.

3. A method according to claim 2, wherein the oxidizing agent is p-toluene thiosulphonic acid or a salt thereof.

4. A method for preparing a photosensitive silver halide element according to claim 1, wherein the precipitation is performed in following conditions of pH and pAg:

pH in the range from 1 up to 10, and pAg in the range from 2 up to 9.

5. The method according to claim 1, wherein the silver halide grains are precipitated so that compounds satisfying formula (I), formula (II), or a combination of formula I and formula II are introduced during precipitation of the silver halide grains via a separated third inlet, wherein the third inlet is mounted in such as way that the hole-trapping dopant is supplied underneath a surface of a solution wherein the silver halide is precipitated.

6. The method according to claim 5 wherein the silver halide grains are precipitated so that compounds satisfying formula (I), formula (II), or a combination of formula I and formula II are introduced during precipitation of the silver halide grains via the separated third inlet, wherein the third inlet is positioned closer to the silver salt inlet than to a halide inlet.

7. The method according to claim 2 where the oxidizing agent is present before the organic hole-trapping dopant is injected in the precipitation step of the silver halide emulsion crystals.

8. The method according to claim 1, wherein the silver halide grains are precipitated by simultaneous addition of the compounds satisfying formula (I), formula (II), or a combination of formula (I) and formula (II) and the silver salt solutions through one inlet.

9. The method according to claim 8, wherein said compounds satisfying formula (I), formula (II), or a combination of formula (I) and formula (II) and silver salt are mixed together before formation of the silver halide.

* * * * *